United States Patent [19]

Dudley

[11] 3,933,611

[45] Jan. 20, 1976

[54] APPARATUS AND METHOD FOR CONTINUOUS ELECTROCOATING

[75] Inventor: Michael Alan Dudley, Beaconsfield, Canada

[73] Assignee: Canada Wire and Cable Limited, Toronto, Canada

[22] Filed: Nov. 14, 1974

[21] Appl. No.: 523,920

[30] Foreign Application Priority Data

May 3, 1974 Canada ..... 198850

[52] U.S. Cl. ..... 204/181; 204/300

[51] Int. Cl.[2] ..... C25D 13/00; B01D 13/02

[58] Field of Search ..... 204/181, 299, 300, 180 R

[56] References Cited

UNITED STATES PATENTS 1,899,016 2/1933 Darby ..... 204/300 X 3,211,639 10/1965 McNeill et al. ..... 204/299

FOREIGN PATENTS OR APPLICATIONS 970,506 9/1962 United Kingdom ..... 204/181

*Primary Examiner*—T. Jung
*Assistant Examiner*—A. C. Prescott
*Attorney, Agent, or Firm*—Fleit & Jacobson

[57] ABSTRACT

An apparatus and method are provided for continuous electrocoating of a conducting substrate with a coating of essentially non-conductive material. The invention is especially characterized by the provision of at least one electrode which converges towards the substrate in the direction of travel of the substrate. The electrode so converges in the direction of travel of the substrate that the rate of deposition of the non-conductive material onto the conducting substrate remains substantially constant throughout the electrocoating operation.

8 Claims, 6 Drawing Figures

APPARATUS AND METHOD FOR CONTINUOUS ELECTROCOATING

This invention relates to an apparatus and method for continuous electrocoating of a conducting substrate with an essentially non conductive material.

Continuous electrocoating or electrophoresis operations are well known in the art. It is known, for example, to apply an insulating material onto electrical wires or metallic strips by continuous electrocoating. The prior art electrocoating cells generally contain at least one electrode parallel to the substrate to be electrocoated. During continuous electrocoating, the use of an electrode parallel to the substrate being coated provides an uneven distribution of current density, which results in an initial heavy deposition rate of the non-conductive material, such as resin, as the substrate to be coated enters the cell, and a reducing rate of deposition as the substrate passes through the remainder of the cell. This is readily understandable, since the electrical resistance between the conductive metallic substrate and the electrode which is parallel thereto will be lower at the entrance point where the substrate is entirely or substantially uncoated, than towards the middle of the cell where the substrate already has acquired a coating of the non-conductive resin thereon, and much lower than at the exit point where the conducting substrate has acquired most if not all of the desired coating of resin.

These uneven conditions are not very satisfactory and often result in a non uniform deposit and promote gas entrapment especially during the early stages of resin deposition.

It has now been surprisingly found that substantial advantages can be realized by using an electrode which converges towards the substrate in the direction of travel of the substrate instead of a parallel electrode as used up to now. These advantages are as follows:

a. constant rate of deposition;
b. better deposit quality due to less entrapped gas during initial deposition; and
c. reduced cell residence time, or shorter cell length, to achieve a same deposit thickness.

Basically, the improved apparatus for continuous electrocoating of a conducting substrate with a coating of essentially non-conductive material comprises an electrocoating bath, means for continuously passing the substrate through such bath, at least one electrode facing at least a portion of the substrate, said electrode converging towards the substrate in the direction of travel of the substrate so that the rate of deposition of the coating material onto the substrate remains substantially constant throughout the electrocoating operation.

It will be appreciated that the conducting substrate may be an electrical conductor such as a wire or a strip of metallic material, e.g. of aluminum, copper, steel or the like. It may also be a more complex article, but it must be adaptable for a continuous electrocoating operation.

The essentially non-conductive material can also be of any desired type. For example, it can be a resin or an organic insulation of any type, so long as it is suitable for electrocoating or electrophoretic deposition on the substrate. There are many such materials known in the art and the particular type of the conducting substrate and/or of the non-conductive material certainly do not affect the essential principle of the present invention which is the use of an electrode converging towards the substrate to be coated in the direction of travel of such substrate.

It is also not important in which way the deposition on the substrate is controlled during the electrocoating operation, whether by constant potential or constant current or some sort of combination of the two. All these variables and materials may easily be adjusted by the man of the art to his particular operation within the scope of this invention.

The electrode will usually be of rectangular shape when a strip or sheet of material is to be electrocoated. However, when the article to be coated is more complex, the electrode will normally be of such shape as to follow the contour of such article. There may be plural electrodes connected in parallel to follow the contour of the article or to coat a strip on both sides. In the case of coating of electrical wires, the electrode or electrodes may be formed so as to substantially or completely surround the wire which is coated with the insulating material.

In addition, the electrode may converge towards the substrate following a steady predetermined slope or it may converge following a predetermined curved path. If the electrode is designed to converge toward the substrate in the direction of travel following a steady predetermined slope, this will not produce a perfectly constant rate of deposition but nonetheless the results will be improved over those obtained by using an electrode parallel to the substrate. In order to obtain a perfectly constant rate of deposition, the electrode must converge following a curved path which ensures a constant current density at the substrate over the entire length thereof from the cell inlet. The closest to constant current density has been obtained using the following equation:

$$d_i = \frac{K\,L\,(W_e + W_s)}{I}(U - U_{fi})$$

where $d_i$ = distance in cm. perpendicular to the substrate between the substrate and the electrode at point $i$ along the length L of the substrate immersed in the electrocoating bath;

K = specific conductance of the electrocoating bath composition in $ohm^{-1}\ cm^{-1}$;

$W_e$ and $W_s$ = width or circumference of the electrode and substrate respectively, in cm.;

$I$ = total current to the cell in amperes;

$U$ = applied voltage $E$ $U_{f_i}$ = voltage drop across the freshly deposited film at point $i$ along the substrate.

The invention will now be further described, by way of example, with reference to the accompanying drawings in which.

Figure 1:
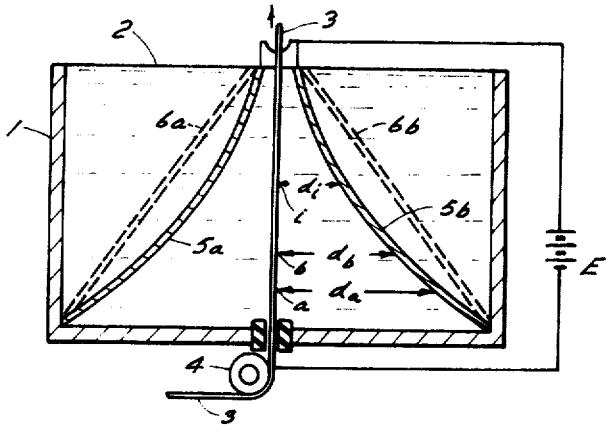
FIG. 1 is a partly sectional illustration of the apparatus of the present invention.

Referring to FIG. 1, there is shown an electrocoating cell 1 containing an electrocoating bath 2 through which a conducting substrate such as a strip 3 is conveyed by roller 4 and additional conveying means (not shown) of conventional type. Cell 1 includes two electrodes 5*a* and 5*b* between which the substrate 3 passes and which converge towards the substrate in such a way as to provide an essentially constant current density at the substrate under operative cell conditions. The electrodes are connected in parallel to the negative terminal of a D.C. source E, the positive terminal of which is connected to the strip. Cell 1 is normally constructed from an insulating material, such as PVC or is at least insulated from both the electrodes 5*a* and 5*b* and the substrate 3.

The profile and shape of such converging electrodes can be determined by considering various factors and, depending on the operational conditions and results desired, one may determine such profile by establishing the distance between the electrodes and the substrate at a number of points within the electrocoating cell. If only two or three points are used for such determination, very probably one can have converging electrodes such as 6*a* and 6*b* sloping at a predetermined angle. This will not produce a perfectly constant rate of deposition at all points, but nonetheless such converging electrodes will result in highly improved conditions over those produced by the use of conventional parallel electrodes.

In order to obtain a constant rate of deposition, the electrodes should converge towards the substrate so as to result in an essentially uniform electrical resistance between them and the travelling substrate under operative cell conditions.

This is achieved when the following equation is satisfied:

$$R_{s1} + R_{f1} = R = R_{s2} + R_{f2} \qquad (1)$$

where:

$R_{s1}$ and $R_{s2}$ are the resistances of the electrocoating bath between the electrode and any point *a* and *b* on the substrate;

$R_{f1}$ and $R_{f2}$ are the resistances of the freshly deposited film, at these points *a* and *b*; and $R$ is the resistance between the electrodes and the substrate.

The profile and shape of the converging electrode may be determined either by using a simple mathematical equation which provides a first approximation to the electrode geometry, or by a rigorous solution using the Laplace equation and suitable boundary conditions.

In either case the operational current density is first selected at the voltage and the film-liquid interface in the continuous electrocoating cell is determined as a function of position in the cell, from static measurements using parallel electrodes, the same electrocoating bath composition and the same current density. The result of the static measurement is film voltage drop as a function of time. For any given line speed, this information can be converted to freshly deposited film voltage drop as a function of position in the cell for continuous coating, if the current density is held at the originally selected operational value.

The specific conductance of the electrocoating bath composition must also be determined.

If it is assumed that current flows perpendicular to the substrate between the substrate and electrodes, the electrode geometry with respect to the substrate may be calculated from the following equation:

$$d_i = \frac{K\,L\,(W_e + W_s)}{I}(U - U_{fi}) \qquad (2)$$

where:

$d_i$ is the distance in cm. perpendicular to the substrate between the substrate and the electrode at point *i* along the length *L* of the substrate immersed in the electrocoating composition;

$K$ is the specific conductance of the electrocoating bath composition, in $ohm^{-1}\ cm^{-1}$;

$W_e$ and $W_s$ are the width or circumference of the electrode and substrate respectively, in cm.;

$I$ is the total current to the cell, in amperes;

$U$ is the applied voltage; and $U_{fi}$ is the voltage drop across the freshly deposited film at point *i* along the substrate, as determined previously by static experiment.

It will be recognized by a man of the art that rigorous design of electrodes which will maintain constant current density at the substrate, over the entire length of the cell, requires solution of the Laplace equation:

$$\Delta^2 \phi = 0 \qquad (3)$$

where:

$\phi$ is the potential in the electrocoating solution between the substrate and the electrodes, and $\Delta^2$ is the well known Laplacian operator. When the substrate is a continuous strip, the Laplacian operator is conveniently expressed in rectangular coordinates. With the further simplification that potential variations across the strip are not considered, since they are irrelevant to the scope of this invention, equation (3) may be written as $$\frac{\delta^2 \phi\,(x, y)}{\delta x^2} + \frac{\delta^2 \phi\,(x, y)}{\delta y^2} = 0 \qquad (4)$$

where $x$ and $y$ are variables denoting position in the electrocoating solution. $x$ at the substrate is equal to zero.

The current density, $J$, at the substrate is related to the potential $\phi$ obtained from solution of equation (4) by the relation $$J = -K\,\frac{\delta \phi\,(x, y)}{\delta x}\,|\,n \to o \qquad (5)$$

Then a suitable procedure for electrode design to achieve constant current density throughout the cell is as follows:

a. assume an electrode geometry, b. evaulate $\phi$ [equation 4 ], and c. evaluate $J$ [equation (5)] as a function of position in the cell. Repeat for different electrode geometries until the desired constant value of $J$ is obtained.

In a typical calculation using this procedure, the following parameters were assumed:

$K = 0.00056\ \text{ohm}^{-1}\ \text{cm}^{-1}$ $L = 18$ in. $I = 2.7$ amps $W_e = 4$ in. $W_g = 1\frac{1}{4}$ in.

Figure 2:
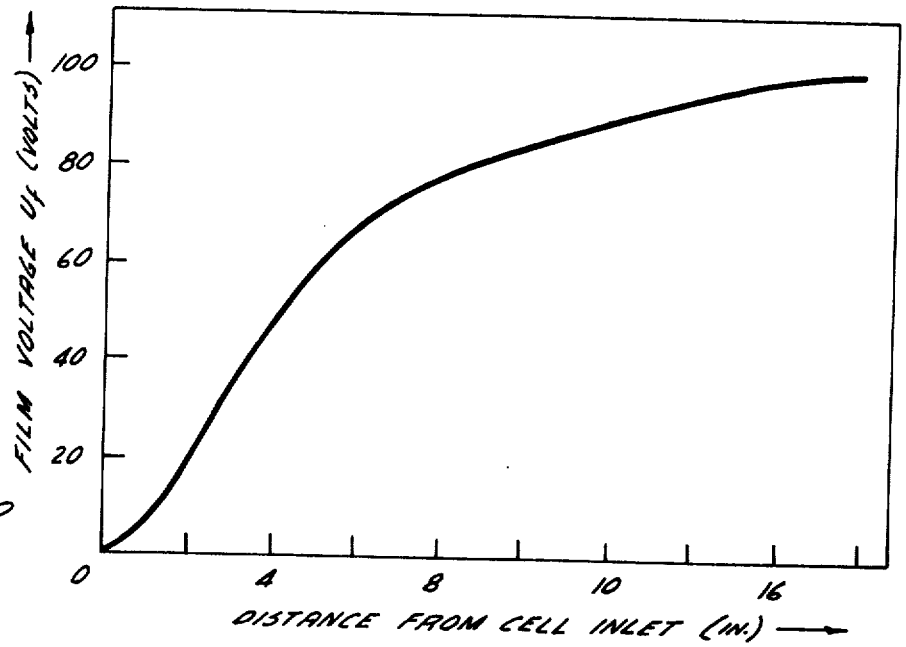
FIG. 2 illustrates the voltage drop across a freshly deposited film as a function of the distance travelled by the substrate being coated from the cell inlet.

The selected current density was 0.06 amps/in.$^2$. The voltage drop versus distance data for this current density, as obtained from a static experiment, are recorded in FIG. 2.

A cell voltage of U = 135 volts was assumed. However, polarization effects have been ignored, and in practice it would be necessary to adjust $U$ until the required current density is achieved. The voltage drop due to polarization is a constant at constant current density, so this assumption does not affect the electrode design.

For this problem, a suitable form of the solution to equation (4) is $$\phi(x,y) = (A_{1m}e^{ax} + A_{2m}e^{-ax})(B_{1m}\sin ay + B_{2m}\cos ay) \quad (6)$$

where the infinite set of constants $A_{1m}, A_{2m}, B_{1m}, B_{2m}$ and $a$ are determined from the boundary conditions so that $\phi(x,y)$ must reduce to the value of the applied potential, $U$, on the electrode, and to the film voltage, $U_f$, on the substrate.

Figure 5:
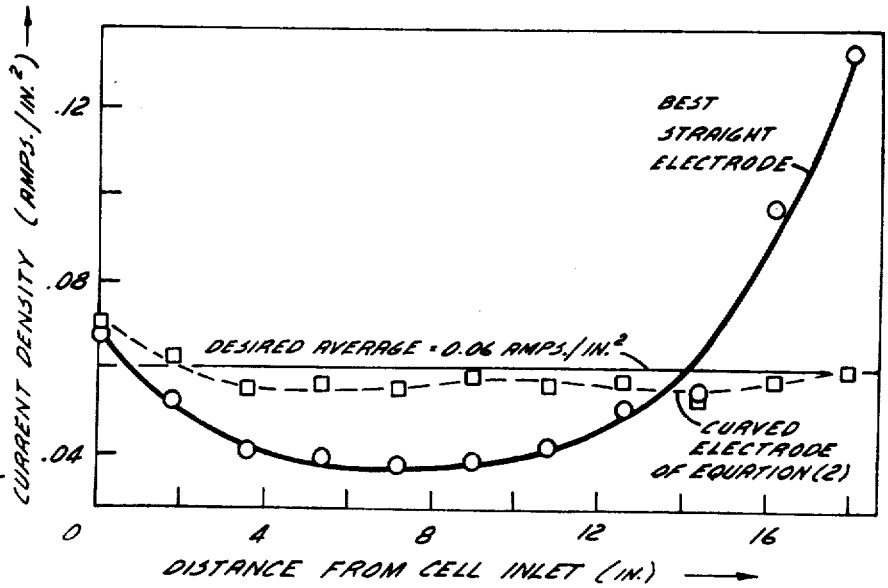
FIG. 5 illustrates the current density versus distance from the cell inlet for the straight and curved electrodes.

$\phi(x,y)$ was evaluated for a number of electrode geometries, and corresponding current density distributions were obtained from equation (5). The closest to constant current density was obtained using the electrode design using the approximate equation (2). This electrode is illustrated as a broken line in FIG. 3. The corresponding equipotential lines calculated from equation (6) are drawn in FIG. 4. The resulting current density at the substrate [equation (5) ] is illustrated by a broken line in FIG. 5. For comparison, FIG. 5 also shows the closest to constant current density which can be obtained with a straight electrode (this electrode is illustrated as a solid line in FIG. 3).

This example demonstrates that equation (2) provides a satisfactory approximation to the electrode geometry which will yield essentially constant current density along the substrate in the continuous cell.

It will therefore be realized that, in this context, the invention provides a great deal of flexibility and adaptability to the particular operational conditions.

Figure 3:
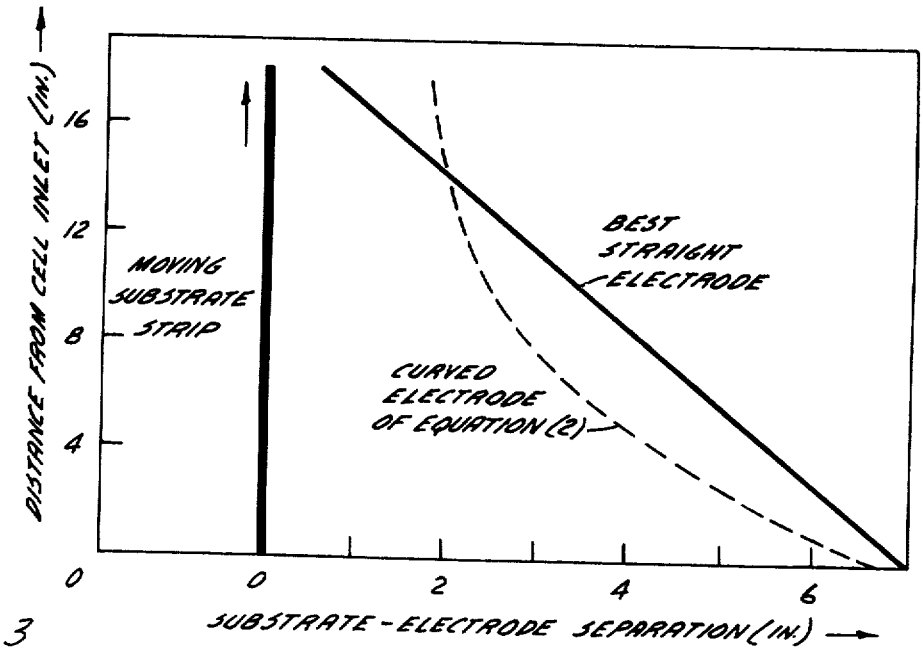
FIG. 3 is a schematic diagram illustrating the substrate-electrode separation versus distance from the cell inltet for a straight electrode and for a curved electrode.
Figure 4:
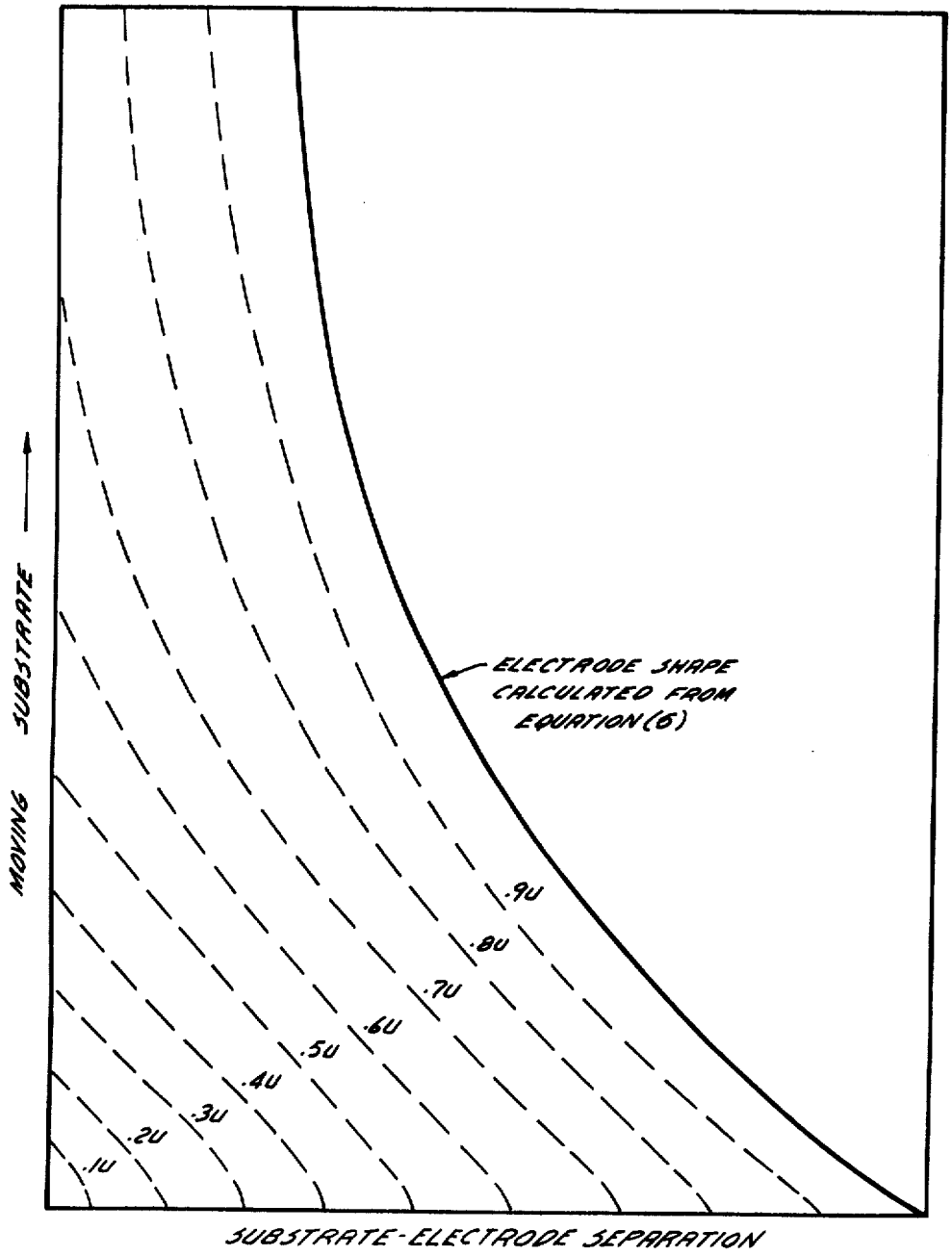
FIG. 4 illustrates equipotential lines for substrate-electrode separations defined from the above equation.

Table I records a comparison of the conventional electrocoating cell (parallel electrodes, substrate-electrode separation 1-5/16 in.) and the converging straight line electrode of FIG. 3. The continuous strip was ($1\frac{1}{4} \times 0.002$ in.) aluminum, run at a line speed of 6 ft./min. with an acrylic electrocoating resin. Both sets of electrodes were 4 in. wide, and the cell length was 18 in. The current to each cell was kept constant at 2.7 amp., or 0.06 amp./in.$^2$ of substrate.

The results show that the average build was 12% greater for the converging electrodes compared to the parallel electrodes, for the same average applied voltage. More important, the strip coated in the converging cell was of much better quality, with fewer gas bubbles.

TABLE I

COMPARISON OF PARALLEL AND CONVERGING ELECTRODE ELECTROCOATING CELLS

| Run No. | Electrode Configuration | Applied Voltage | Thickness of Coating ($10^3$ in.) |
|---|---|---|---|
| TC 1 | Converging | 131 | 1.5 |
| TC 2 | Converging | 121 | 1.6 |
| TC 3 | Converging | 125 | 1.5 |

TABLE I-continued

COMPARISON OF PARALLEL AND CONVERGING ELECTRODE ELECTROCOATING CELLS

| Run No. | Electrode Configuration | Applied Voltage | Thickness of Coating ($10^3$ in.) |
|---|---|---|---|
| TC 4 | Converging | 120 | 1.65 |
| | Average = | 124 | 1.56 |
| TG 1 | Parallel | 128 | 1.4 |
| TG 2 | Parallel | 126 | 1.4 |
| TG 3 | Parallel | 122 | 1.4 |
| TG 4 | Parallel | 121 | 1.4 |
| | Average = | 124 | 1.4 |

In a further example Table II provides a comparison of the cell residence times required for a given resin deposit thickness at similar line speeds for the conventional cell using parallel electrodes and the novel cell using converging electrodes. The advantages of the shorter residence time required by the novel cell are two-fold:

a. Firstly, one may use higher line speeds with cells of the same substrate immersion length.

b. Secondly, as demonstrated in Table II, the required cell length for a given line speed and thickness is shorter using the novel cell, an important factor in the design of commercial vertical continuous-electrocoating machines.

TABLE II

COMPARISON OF CELL RESIDENCE TIMES AND REQUIRED CELL LENGTHS FOR PARALLEL AND CONVERGING ELECTRODES

| Electrode Configuration | Line Speed, fpm | Applied Voltage | Average Film Thickness, in. | Required Cell Residence Time, Sec | Required Cell Length, in. |
|---|---|---|---|---|---|
| Parallel | 9 | 180 | 0.00060 | 10.0 | 18.0 |
| Converging | 9 | 180 | 0.00075 | 5.0 | 9.0 |
| Parallel | 10 | 180 | 0.00055 | 9.0 | 18.0 |
| Converging | 10 | 185 | 0.00050 | 3.6 | 7.3 |
| Parallel | 16 | 160 | 0.00045 | 5.6 | 18.0 |
| Converging | 16 | 160 | 0.00045 | 2.7 | 8.5 |

Figure 6:
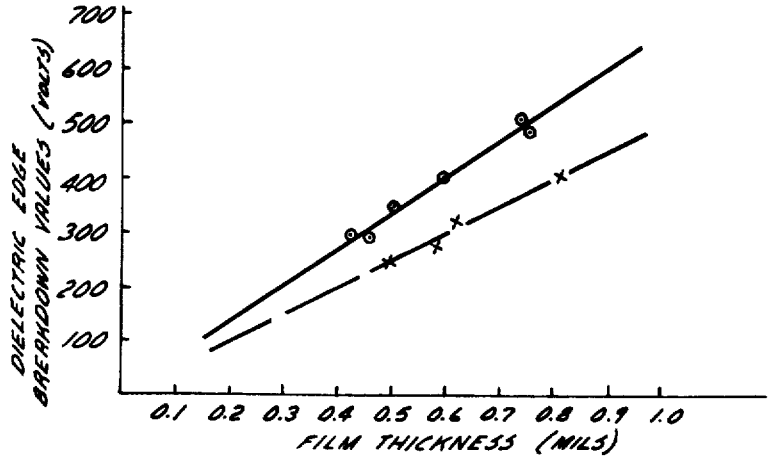
FIG. 6 illustrates the dielectric edge breakdown voltage versus film thickness for an electrode paralled to the substrate and an electrode converging toward the substrate.

FIG. 6 provides a comparison of the dielectric breakdown voltage values at the edge of an aluminum strip continuously coated with a coat of resin using a conventional cell with parallel electrodes and the novel cell using converging electrodes in accordance with this invention. In FIG. 6, the results of conventional coating are illustrated by the broken line and those of the coating in accordance with this invention are illustrated by the continuous line. It will be seen from this figure that the value of 400 volts for edge dielectric breakdown is achieved with 0.0006 in. of resin deposited in accordance with this invention, but it requires 0.0008 in. of resin thickness to achieve a coating of similar electrical quality in accordance with a conventional operation using parallel electrodes. It is therefore obvious that the constant current density conditions which are achieved using converging electrodes provide a better quality deposit which could not be forseen from prior art.

What is claimed is:

1. An apparatus for continuously electrocoating a conducting substrate with essentially non-conductive material, comprising: means for continuously passing said substrate through an electrocoating bath; and at least one electrode facing at least a portion of the substrate, said electrode converging towards the substrate in the direction of travel of the substrate so that the rate of deposition of the coating material onto the substrate remains substantially constant throughout the electrocoating operation.

2. An apparatus as defined in claim 1, wherein said electrode converges following a steady predetermined slope.

3. An apparatus as defined in claim 1, wherein the substrate is a strip and wherein two plate-like electrodes are provided so as to be one on each side of the strip and connected in parallel so as to coat both sides of the strip.

4. An apparatus as defined in claim 1, wherein the substrate is a wire and wherein the electrode is formed so as to surround the wire.

5. An apparatus as defined in claim 1, wherein the substrate has a predetermined cross-section and wherein the electrode is formed so as to follow the contour of said substrate.

6. An apparatus as defined in claim 1, wherein the substrate has a predetermined cross-section and wherein plural electrodes are provided to follow the contour of said substrate.

7. A process for continuously electrocoating a conducting substrate with essentially non-conductive material, the process comprising the steps of: positioning at least one electrode in an electrocoating bath so as to face at least a portion of said substrate when being electrocoated, said electrode converging towards the substrate in one direction; and continuously passing said substrate through said electrocoating bath in said one direction so that the rate of deposition of the coating material onto the substrate remains substantially constant throughout the electrocoating operation.

8. A process as defined in claim 7, wherein said electrode converges following a predetermined curved path satisfying the following equation:

$$d_i = \frac{K\,L\,(W_e + W_s)}{I}(U - U_{fi})$$

where:

$d_i$ = distance in cm. perpendicular to the substrate between the substrate and the electrode at point $i$ along the length L of the substrate immersed in the electrocoating bath;

$K$ = specific conductance of the electrocoating bath composition in $ohm^{-1}\ cm^{-1}$;

$W_e$ and $W_s$ = width or circumference of the electrode and substrate respectively in cm;

$I$ = total current to the cell in amp;

$U$ = voltage applied to the electrode;

$U_{fi}$ = voltage drop across the freshly deposited film at point $i$ along the substrate.

* * * * *